US006102396A

United States Patent [19]

Liu

[11] Patent Number: 6,102,396

[45] Date of Patent: Aug. 15, 2000

[54] ROTATING WHEEL ASSEMBLY FOR SLOT MACHINES

[76] Inventor: Jeff Liu, No. 22-6, Chung Chou, Hsi Kang Tsun, Hsi Kang Shiang, Tainan Hsien, Taiwan

[21] Appl. No.: 09/244,168

[22] Filed: Feb. 4, 1999

[51] Int. Cl.[7] ..... A63F 5/04; G07F 17/34

[52] U.S. Cl. ..... 273/143 R

[58] Field of Search ..... 273/143 R, 138.2; 463/20

[56] References Cited

U.S. PATENT DOCUMENTS

| | | | |
|---|---|---|---|
| 4,621,815 | 11/1986 | Yamamoto | 273/143 R |
| 5,209,477 | 5/1993 | Heidel et al. | 273/143 R |
| 5,388,829 | 2/1995 | Holmes | 273/143 R |
| 5,688,172 | 11/1997 | Regidor | 273/143 R |

FOREIGN PATENT DOCUMENTS

| | | | |
|---|---|---|---|
| 404253879 | 9/1992 | Japan | 273/143 R |
| 2182478 | 5/1987 | United Kingdom | 273/143 R |

*Primary Examiner*—Benjamin H. Layno
*Attorney, Agent, or Firm*—Rosenberg, Klein & Lee

[57] ABSTRACT

A rotating wheel assembly includes a base that is releasably attached to a frame of a slot machine. The rotating wheel assembly further includes a rotating wheel consisting of an outer ring and an inner ring that are releasably engaged together to allow adjustment in the width. Each of the inner ring and the outer ring includes a retaining groove for holding a figure card. A lamp device is mounted inside the rotating wheel and secured to a cylinder, which, in turn, is releasably engaged with a circular member on the base to allow a change in the angular position. A shielding plate is releasably attached to a rim of the inner ring to allow adjustment of position of the shielding plate in response to wrong discrimination as a result of long-term use of the rotating wheel assembly.

2 Claims, 10 Drawing Sheets

ROTATING WHEEL ASSEMBLY FOR SLOT MACHINES

BACKGROUND OF THE INVENTION

1. Field of the Invention

The present invention relates to a rotating wheel assembly for slot machines, and more particularly to a rotating wheel assembly having a number of modules to allow easy maintenance and replacement of the elements thereof.

2. Description of the Related Art

A slot machine is popular in the modern world and includes a number of wheel rotating assemblies. FIGS. 10 and 11 of the drawings illustrate a typical rotating wheel assembly for a slot machine. The rotating wheel assembly includes a base 9, a step motor 91, a rotating wheel 93 is secured on an output shaft of the step motor 91 to rotate therewith, a figure card 94 is adhered to an outer periphery of the rotating wheel 93, a photoelectric element 92 attached to the base 9, and a shield bar 95 attached to a supporting rib (not labeled) of the rotating wheel 93. When the rotating wheel 93 stops, the figure on the figure card displayed to the player is discriminated according to the position of the shield bar 95 relative to the photoelectric element 92. The rotating wheel 93 is so frequently turned that it often malfunctions. Yet, the elements that constitute the rotating wheel 93 are fixed and thus result in inconvenience to maintenance and replacement. A further disadvantage resides in that the elements of the rotating wheel 93 cannot be applied to slot machines with base frames of different shapes and sizes. The present invention is intended to provide an improved rotating wheel assembly that mitigates and/or obviates the above problems.

SUMMARY OF THE INVENTION

It is a primary object of the present invention to provide an improved rotating wheel assembly that includes a number of modules to allow easy maintenance and replacement. The rotating wheel assembly includes a base that is releasably attached to a frame of a slot machine. The rotating wheel assembly further includes a rotating wheel consisting of an outer ring and an inner ring that are releasably engaged together to allow adjustment in the width. Each of the inner ring and the outer ring includes a groove for holding a figure card. A lamp device is mounted inside the rotating wheel and secured to a cylinder, which, in turn, is releasably engaged with a circular member on the base to allow a change in the angular position. In addition, a shielding plate is releasably attached to a rim of the inner ring to allow adjustment of position of the shielding plate in response to wrong discrimination as a result of long-term use of the rotating wheel assembly.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
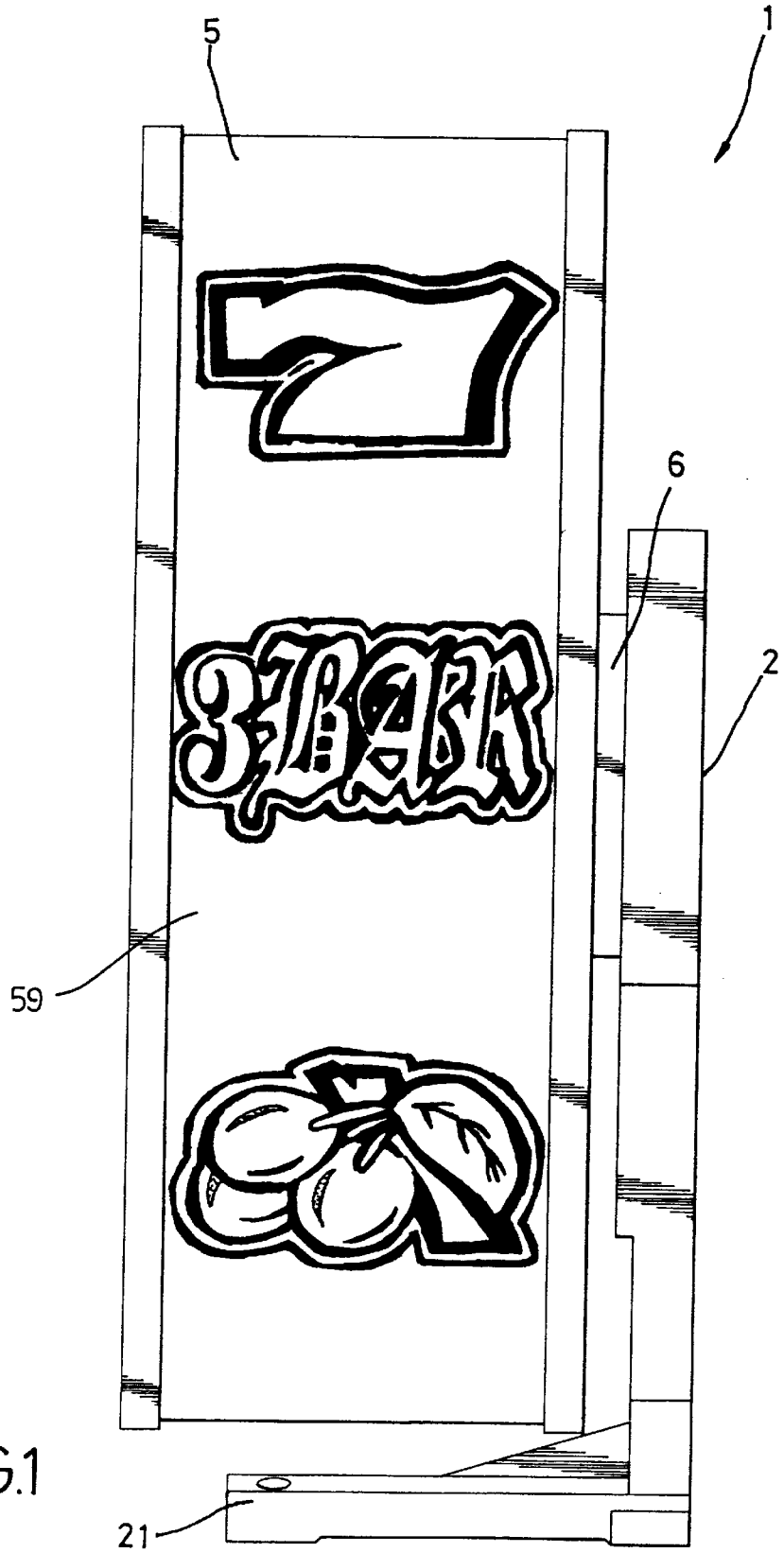
FIG. 1 is a side view of a rotating wheel assembly in accordance with the present invention.
Figure 2:
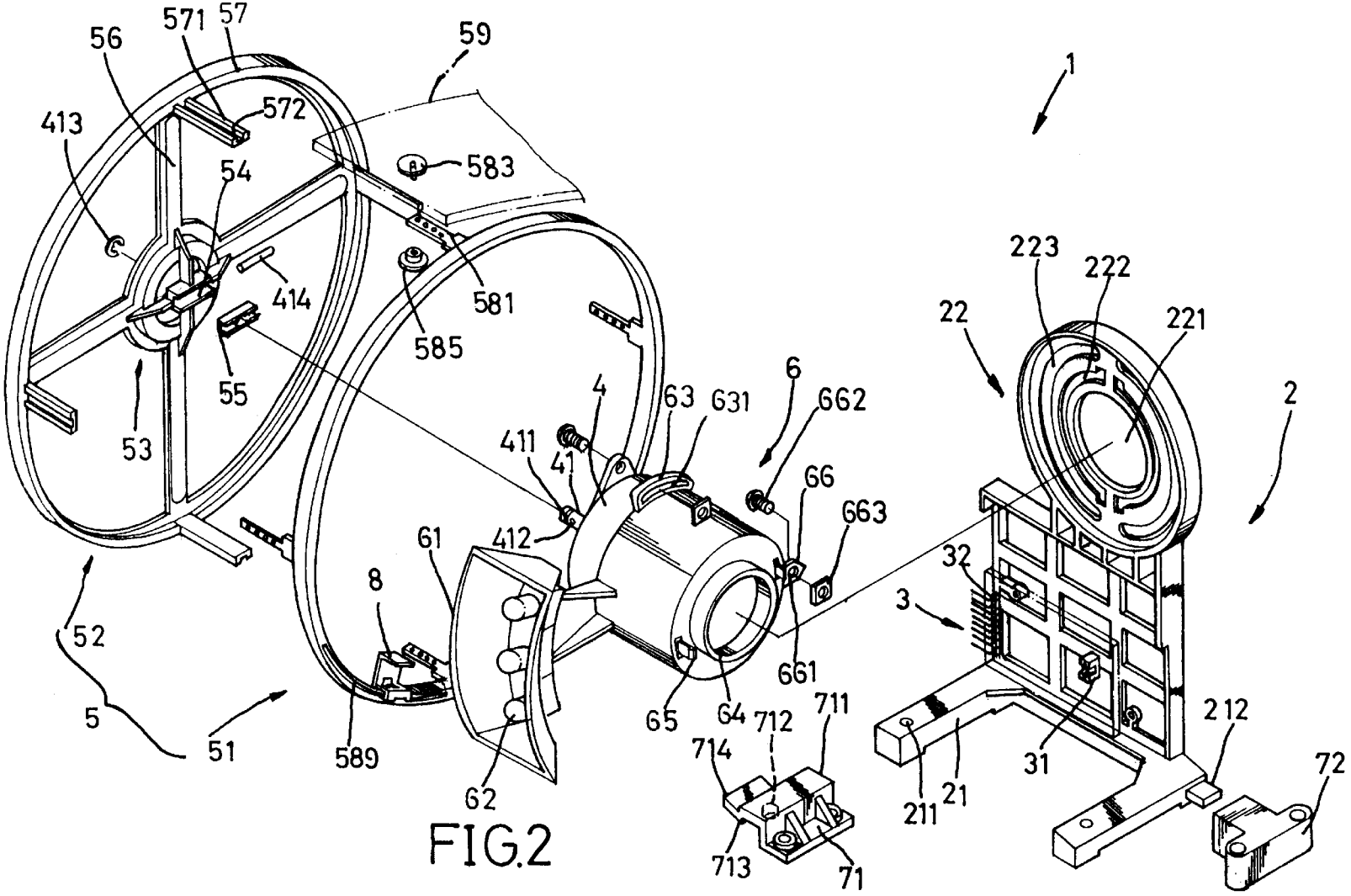
FIG. 2 is an exploded perspective view of the rotating wheel assembly in accordance with the present invention.

Referring to FIGS. 1 to 9 and initially to FIG. 2, a rotating wheel assembly for slot machines in accordance with the present invention generally includes a base 2, a circuit board 3 attached to the base 2, a motor 4 mounted on top of the base 2, and a rotating wheel 5 mounted to an output shaft 41 of the motor 4 to rotate therewith. A lamp device 62 is mounted in the rotating wheel 5 for illumination, which will be described later.

Figure 3:
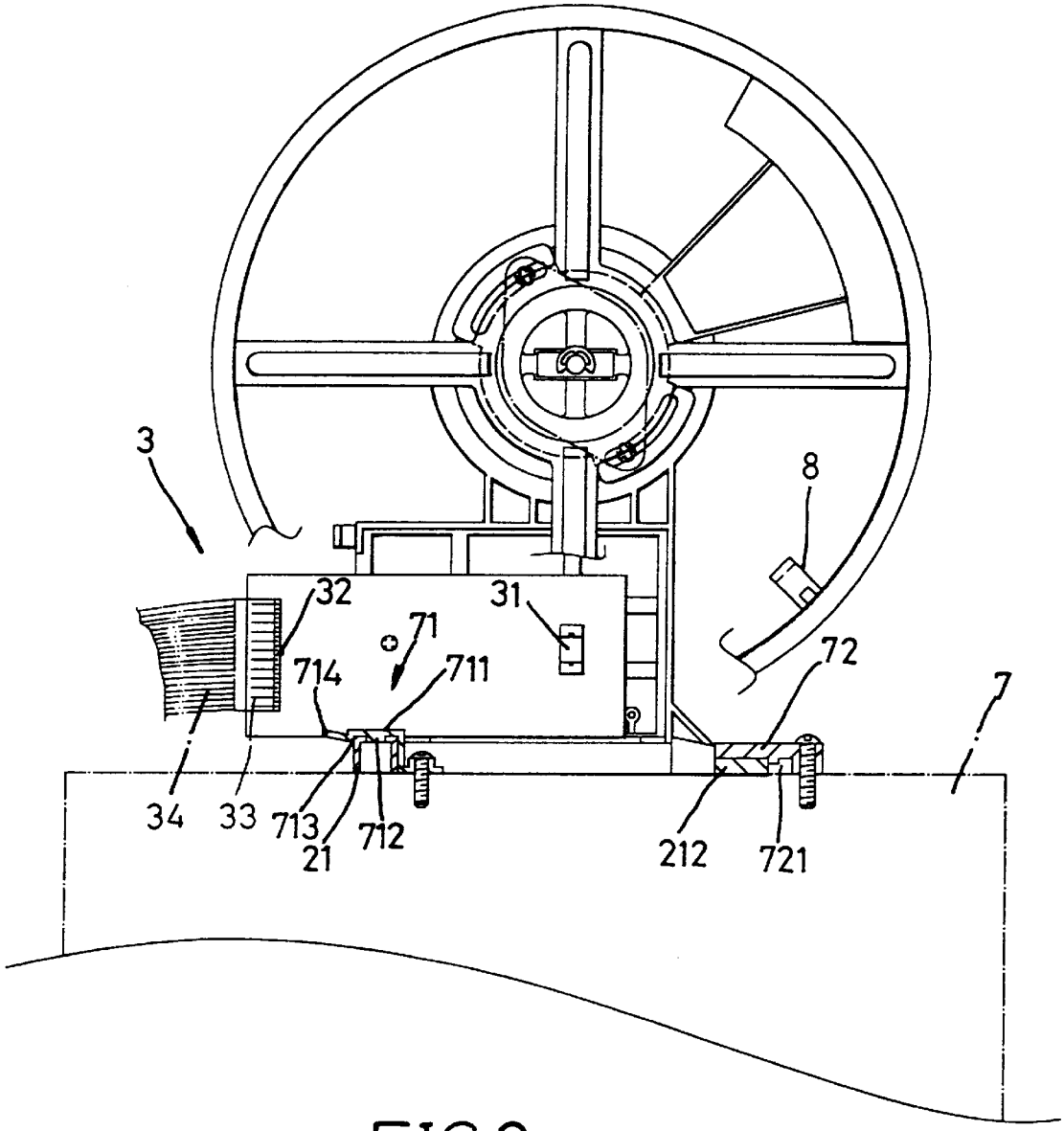
FIG. 3 is a front view of the rotating wheel assembly and a frame of a slot machine.
Figure 4:
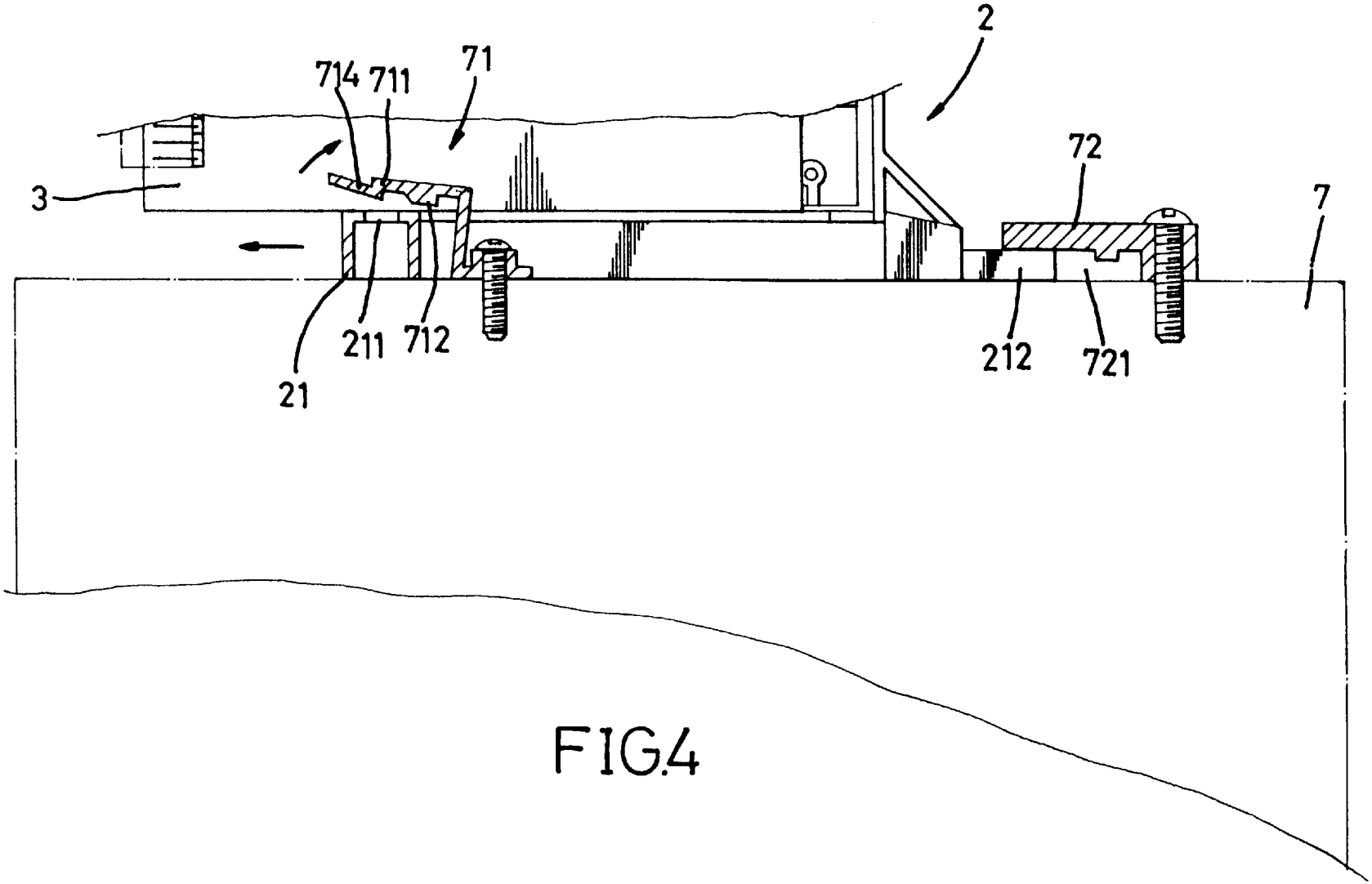
FIG. 4 is an enlarged fragmentary side view illustrating disengagement of a base from the frame in FIG. 3.

The base 2 includes two horizontal beams 21 projected therefrom. One of the beams 21 includes a hole 211 defined therein, while the other beam 21 includes a lug 212 extended from a lateral side thereof. Referring to FIGS. 2 and 3, an engaging block 71 and a sleeve block 72 are detachably screwed to a frame 7 of a slot machine. The sleeve block 72 includes a receptacle 721 for receiving the lug 212 of the beam 21 on the base 2. The engaging block 71 includes a top plate 711 having an insert 712 on an underside thereof so as to be received in the hole 211 of the beam 21 on the base 2. An operative member 714 extends from the cover plate 711 and includes an engaging hook 713 on an underside thereof for engaging with a lateral side of the beam 21 with the hole 211. Thus, the base 2 is secured to the frame 7 of the slot machine, best shown in FIG. 3. The base 2 is removable by means of disengaging the beams 21 from the engaging block 71 and the sleeve block 72 to allow easy replacement and maintenance. It can be achieved by means of simple operation of moving the operative member 714 away from the beam 21, as shown in FIG. 4.

The circuit board 3 mounted in the base 2 controls rotations of the motor 4, illumination of the lamp device 6, and discrimination of angular position of the rotating wheel 5. As can be seen from FIG. 3, the circuit board 3 includes a U-shaped photoelectric element 31 and a number of pins 30 for connection with a cable connector 33 through which a main circuit board (not shown) of the slot machine is electrically connected to the circuit board 3 by a power line and signal control lines 34. Thus, the circuit board 3 is separate from the power line and the signal control lines 34.

Figure 5:
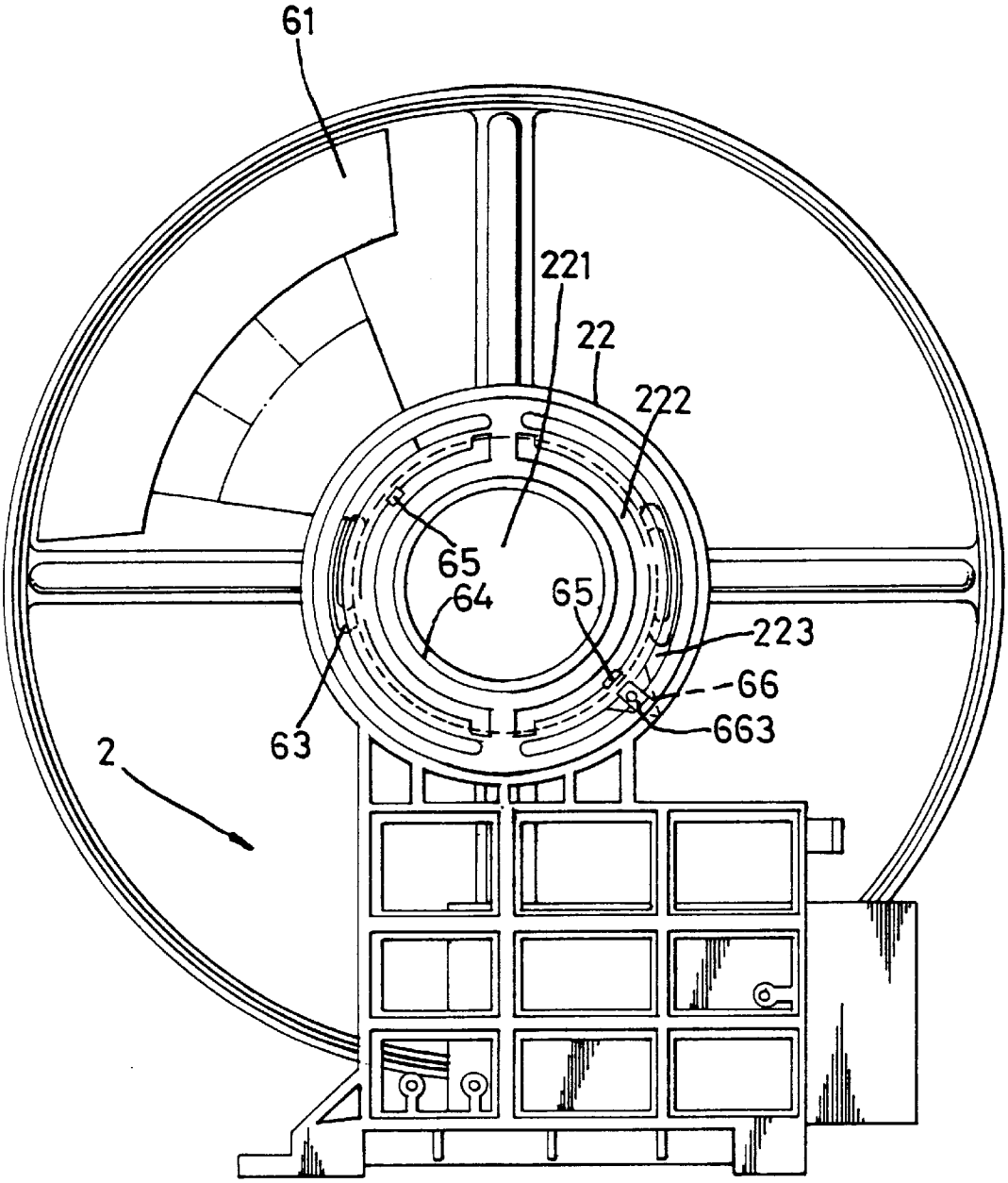
FIG. 5 is a front view of the rotating wheel assembly.
Figure 6:
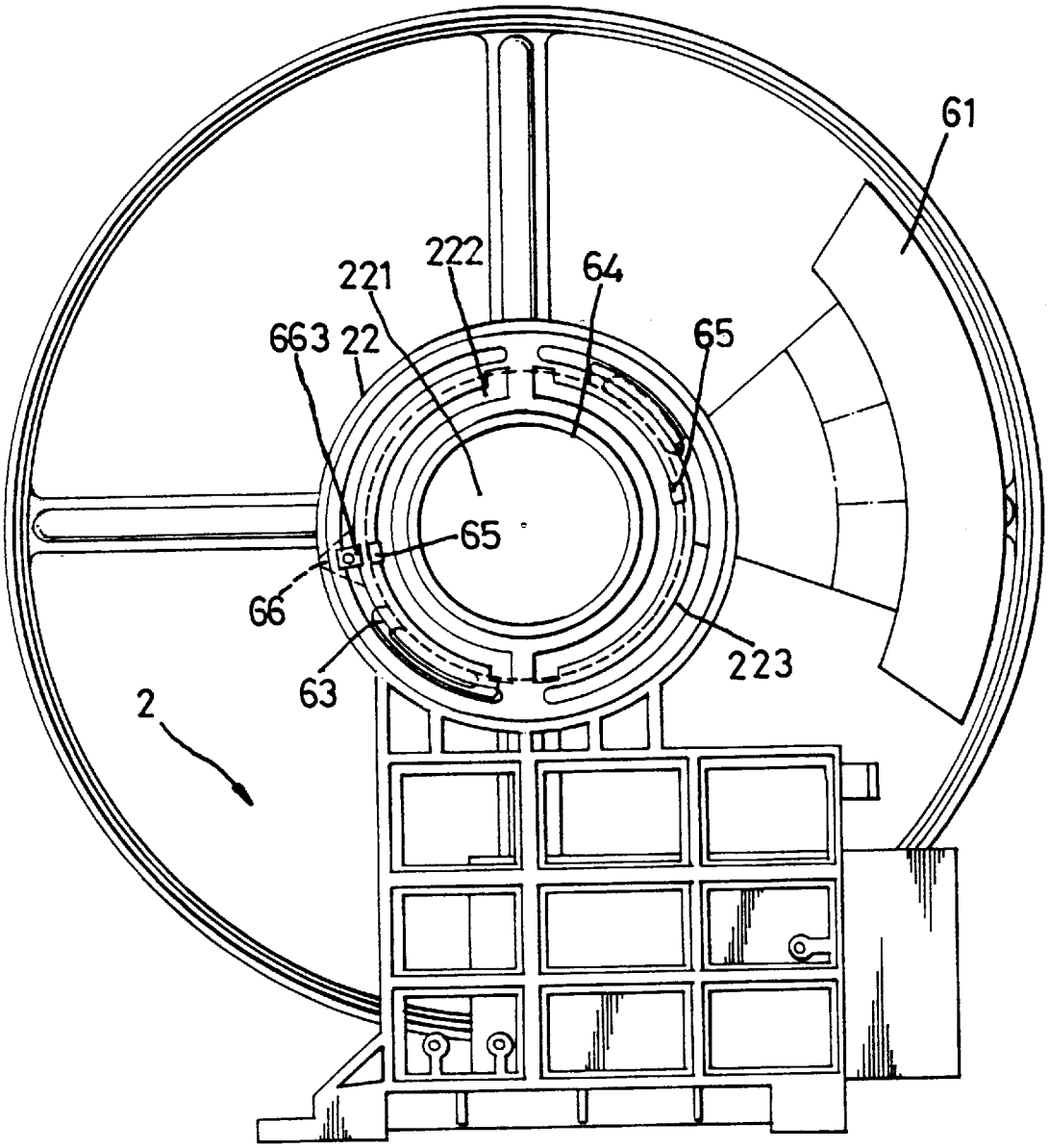
FIG. 6 is a view similar to FIG. 5, wherein the lamp device is mounted on the other side of the rotating wheel.

Referring to FIGS. 1, 2, and 5, mounted on top of the base 2 is a circular member 22 that includes a central hole 221, two diametrically disposed semi-circular engaging grooves 222 arranged around the central hole 221, and two diametrically disposed positioning grooves 223 arranged around the central hole 221. A cylinder 6 includes a flange 64 formed on an end face thereof. The flange 64 is fittingly received in the central hole 221 of the circular member 221. A lamp holder 61 is attached to an outer periphery of the cylinder 6, and the lamp device 62 is mounted in the lamp holder 61. Two hooks 65 are diametrically disposed on the end face of the cylinder 6 and located outside the flange 64 for slidably engaging with the engaging grooves 222. Thus, the cylinder 6 is adjustably mounted to the circular member 2 to allow adjustment of angular position of the lamp device 62 (see FIGS. 5 and 6). A tab 66 extends outwardly from the cylinder 6 and includes a hole 661. A screw 662 is extended through the hole 661 to engage with a washer 663 positioned in one of the positioning groove 223 to thereby secure the cylinder 6 in place. The angular position of the lamp device 6 is thus fixed, as shown in FIGS. 5 and 6.

Referring to FIG. 2, the cylinder 6 further includes two diametrically disposed mounting members 63 on the outer periphery thereof. The motor 4 is detachably screwed to the slots 631 in the mounting members 63, thereby securely fixing the motor 4 in the cylinder 6.

Figure 7:
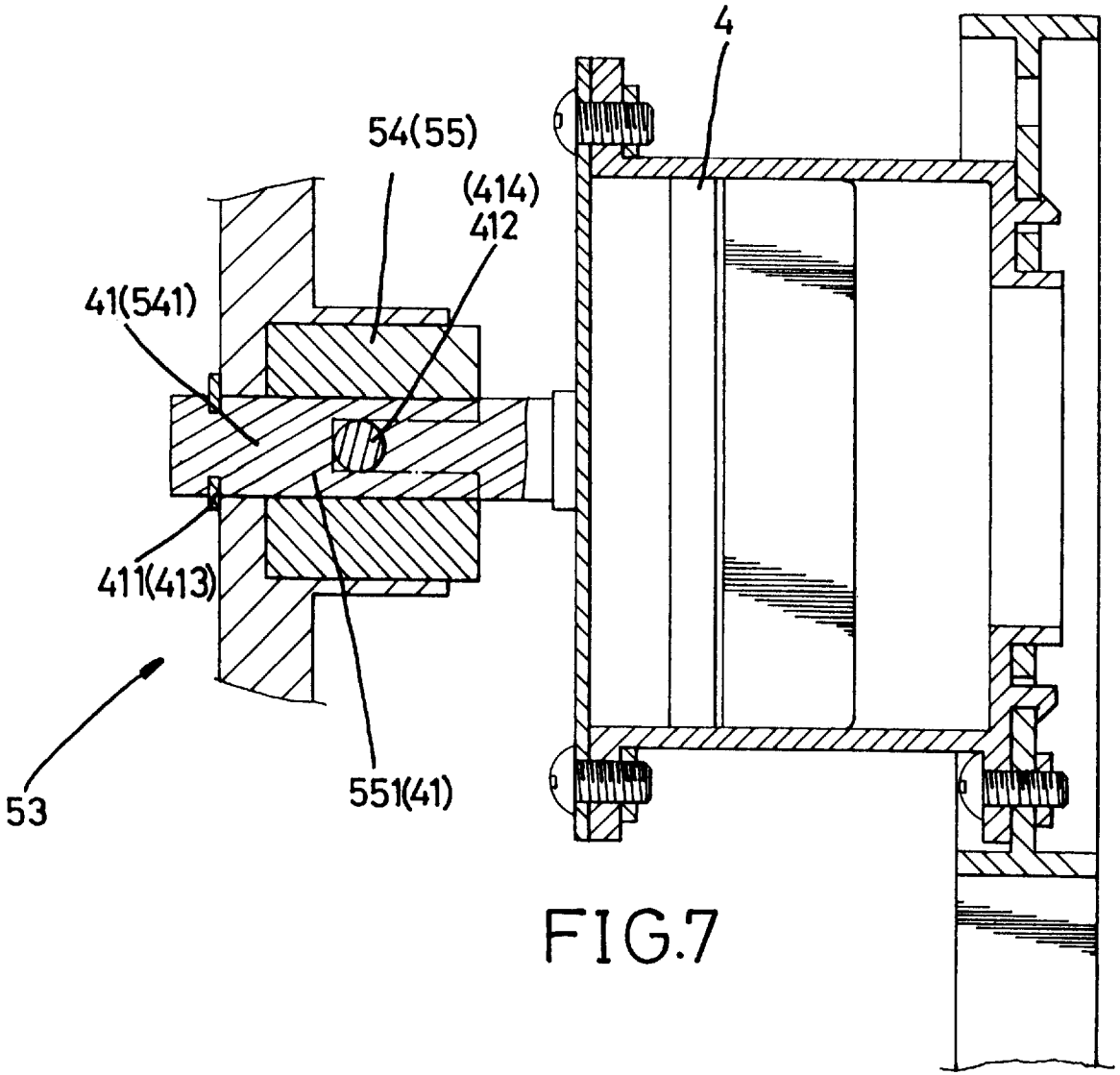
FIG. 7 is an enlarged sectional view illustrating engagement between a motor and an outer ring of the rotating wheel.

The rotating wheel 5 includes an outer ring 52 and an inner ring 51. The outer ring 52 includes a rim 57 supported by a number of radial ribs 56. An axle section 53 is formed in a center of the outer ring 52 for engaging with the output shaft 41 of the motor 4. Referring to FIGS. 2 and 7, the axle section 53 includes an engaging groove 54, and a bottom wall that defines the engaging groove 54 includes a hole 541. A U-shaped member 55 is received in the engaging groove 54 and includes a hole 551. The output shaft 41 of the motor 4 includes an annular groove 411 and a transverse key hole 412. When the outer ring 52 engages with the output shaft 41, the output shaft 41 extends through the hole 551 of the U-shaped member 55 and the hole 541 of the engaging groove 54. A C-clip 413 is mounted in the annular groove 411 of the output shaft 41, and a key 414 is inserted into the key hole 412 and bears against a mediate section of the U-shaped member 55 to thereby securely engage the outer ring 52 and the output shaft 41.

Figure 8:
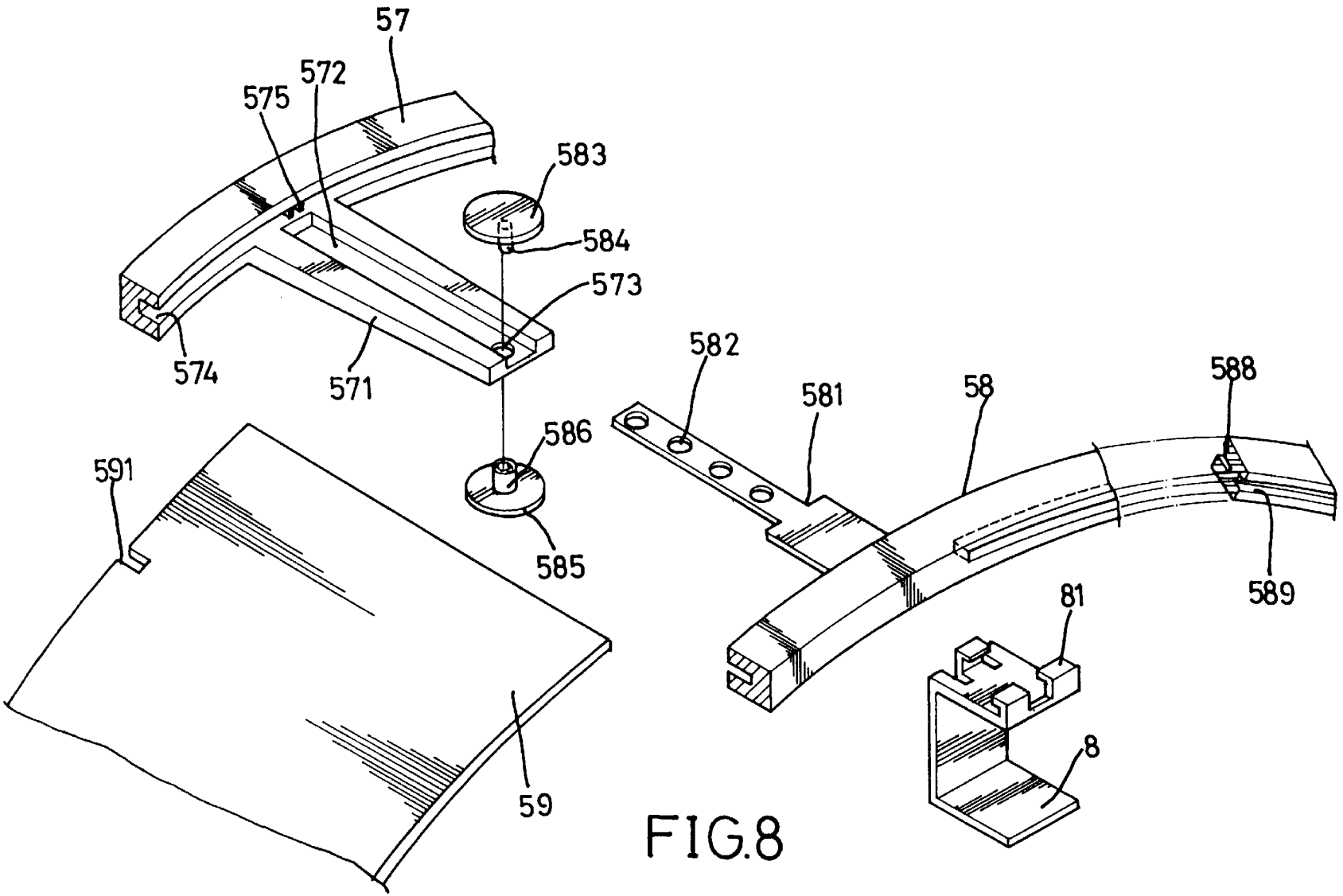
FIG. 8 is a partial exploded perspective view illustrating engagement between the outer ring, an inner ring, and a figure card.

Referring to FIGS. 2 and 8, a number of female extension 571 extend outwardly from the rim 57 toward the inner ring 51 in a direction normal to a plane on which the rim 57 locates. Each female extension 571 includes an engaging groove 572, and a bottom wall that defines the engaging groove 572 includes a hole 573. The inner ring 51 includes a rim 58 from which a number of male extensions 581 extend in a direction normal to a plane on which the rim 58 locates. Each male extension 581 is engaged with the engaging groove 572 of an associated female extension 571. Each male extension 581 includes a number of holes 582. A stem 584 of a male pin 583 is extended from an upper side of the female extension 571 through one of the holes 582 of the male extension 581 and the hole 573 of the female extension 571. A female pin 585 is provided on an underside of the female extension 571 and includes a holed stem 586 for fitting receiving the stem 584 of the male pin 583. Thus, the overall width of the rotating wheel 5 constituted by the inner ring 51 and the outer ring 52 is adjustable by means of placing the stem 584 of the male pin 583 in different holes 582 of the male extension 581.

Figure 9:
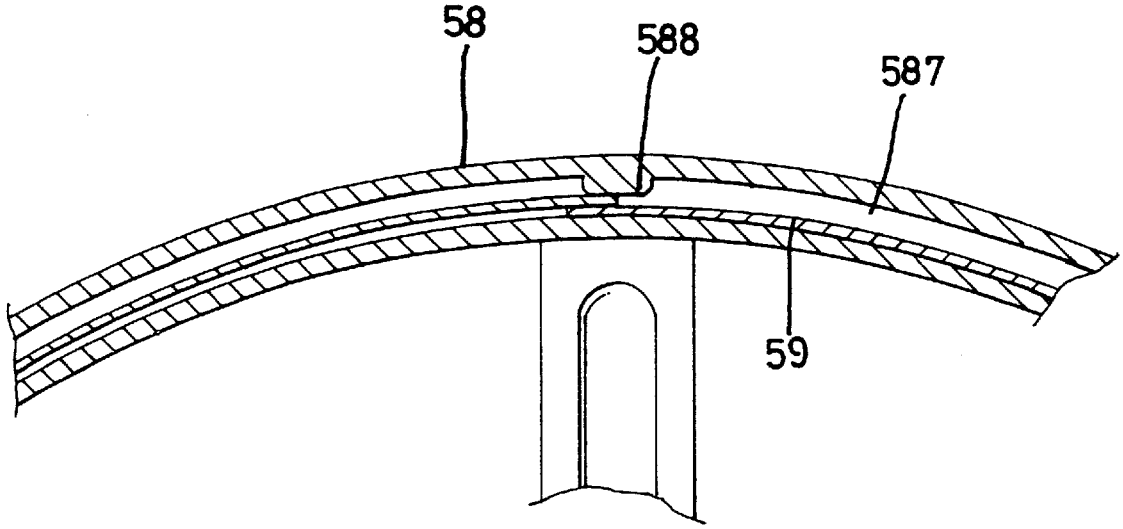
FIG. 9 is a partial sectional view illustrating positioning of the figure card.
Figure 11:
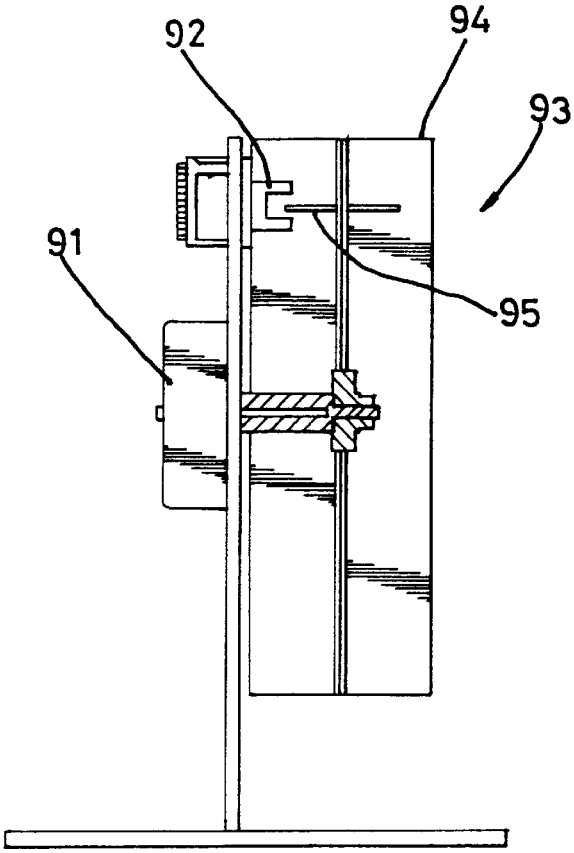
FIG.11 PRIOR ART
FIG. 11 is a side view of the conventional rotating wheel assembly.
Figure 10:
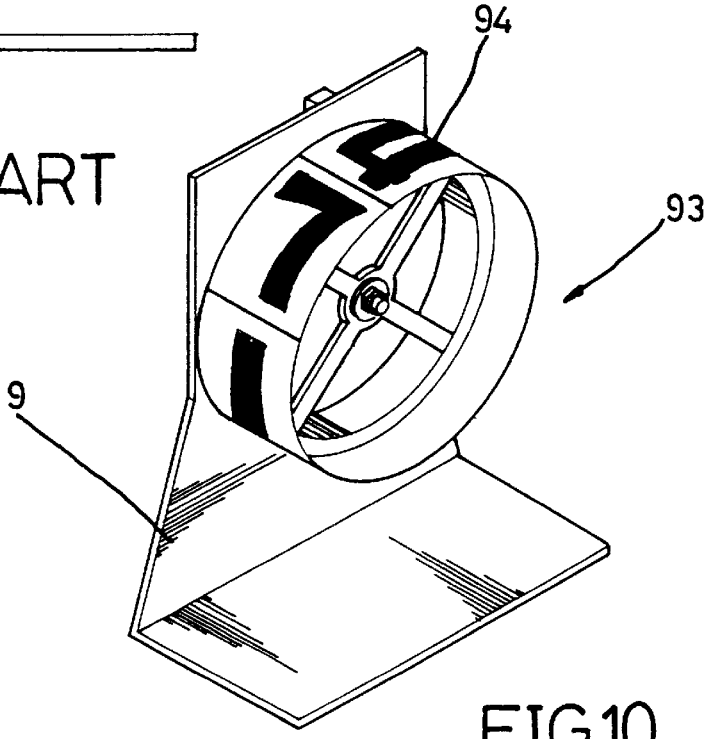
FIG.10 PRIOR ART
FIG. 10 is a perspective view of a conventional rotating wheel assembly.

Referring to FIGS. 2, 8, and 9, the rim 57 of the outer ring 52 includes a retaining groove 574, while the rim 58 of the inner ring 51 includes a retaining groove 587. The rims 57 and 58 have an identical diameter, and the retaining grooves 574 and 587 together define a retaining groove for holding the figure card 59 that has a number of figures on a side thereof (FIG. 1).

An engaging piece 575 is formed in the retaining groove 574, while a retaining block 588 is formed in the retaining groove 587. The figure card 59 includes a notch 591 (FIG. 8) that engages with the engaging piece 575, while two ends of the figure card 59 wound in the retaining grooves 574 and 587 are overlapped and retained in place by the retaining block 588, best shown in FIG. 9.

Referring to FIG. 8, the rim 58 of the inner ring 51 further includes a reference groove 589 that faces away from the outer ring 52. The location of the reference groove 589 corresponds to a specific figure on the figure card 59. A U-shaped shielding plate 8 is adjustably attached to the rim 58 by means of engaging a hook device 81 of the shielding plate 8 with the reference groove 589 and the retaining groove 588. In use, the shielding plate 8 passes through the photoelectric element 31 such that the circuit board 3 may discriminate which figure is displayed to the player, which is conventional and therefore not described in detail. If the figures of on all rotating wheels of the slot machine are not properly aligned, position of the shielding plate 8 relative to the reference groove 589 is adjusted to solve this misalignment problem.

According to the above description, it is appreciated that the rotating wheel assembly in accordance with the present invention includes the following advantages:

1. The elements of the rotating wheel assembly are separated into several modules to allow easy maintenance and replacement. More specifically, the base 2 is detachably connected to the frame 7, the circuit board 3 is separate from the power line and the signal control lines 34 from the main circuit board of the slot machine, and the figure card 5 is detachably retained in the inner ring 51 and the outer ring 52.
2. The angular position of the lamp device 62 is adjustable and thus can be used in all kinds of slot machines. The overall width of the rotating wheel 5 is adjustable so as to be used with figure cards of different width. The shielding plate 8 is adjustable relative to the reference groove 589 to thereby allow adjustment of the figures on the figure card 59 to align with the lamp device 62.

Although the invention has been explained in relation to its preferred embodiment, it is to be understood that many other possible modifications and variations can be made without departing from the spirit and scope of the invention as hereinafter claimed.

What is claimed is:

1. A rotating wheel assembly for a slot machine, comprising:

a base (2) including two horizontal beams (21), a circular member (22) mounted on top of the base (2) and including a central circular hole (221), two diametrically disposed semicircular engaging grooves (222) around the central circular hole (221), and two diametrically disposed positioning grooves (223) around the engaging grooves (222), a circuit board (3) secured to the base (2) and includes a plurality of pins (32) adapted to be electrically connected with a power line and signal control lines from a main circuit board of a slot machine, the circuit board (3) further including a photoelectric element (31) provided thereon, a cylinder (6) including an outer periphery and an end face, a flange (64) being formed on the end face and received in the central circular hole (221) of the circular member (22), two diametrically disposed hooks (65) being formed on the end face and outside the flange (64) for slidingly engaging with the engaging grooves (222) of the circular member (22), a tab (66) with a hole (661) being formed on the outer periphery of the cylinder (6), a washer (663) being secured in one of the positioning grooves (223), a screw (662) being extended through the hole (661) of the tab (66) and the washer (663) to retain the cylinder (6) in place, a lamp holder (61) being formed on the outer periphery of the cylinder (6) for receiving a lamp device (62) therein, two diametrically disposed mounting member (63) being formed on the outer periphery of the cylinder (6) and each including an arcuate slot (631), a motor (4) mounted in the cylinder (6) and screwed to the arcuate slots (631) of the mounting members (63), the motor (4) including an output shaft (41) that has an annular groove (411) and a transverse key hole (412), a figure card (59) having a plurality of figures on a side thereof and including a notch (591), an outer ring (51) including a rim (57), a central axle section (53), and a plurality of radial ribs (56) interconnecting the rim (57) with the axle section (53), the axle section (53) includes an engaging groove (54), a bottom wall that defines the engaging groove (54) including a hole (541), a U-shaped member (55) being received in the engaging groove (54) and including a hole (551) defined in a mediate section thereof and aligned with the hole (541), the output shaft (41) of the motor (4) being extended through the holes (541 and 551), a C-clip (413) being mounted in the annular groove (411) of the output shaft (41), and a key (414) being mounted in the transverse key hole (412), a plurality of female extensions (571) projecting from the rim (57) and extending in a direction normal to a plane on which the rim (57) locates, each said female extension (571) including an engaging groove (572), a bottom wall that defines the engaging groove (572) including a hole (573), the rim (57) further including a retaining groove (574) therein and an engaging piece (575) in the retaining groove (575), an inner ring (51) including a rim (58) having a diameter the same as that of the rim (57) of outer ring (52), a plurality of male extensions (581) projecting from the rim (58) and extending toward the outer ring (52) in a direction normal to a plane on which the rim (57) locates, each said male extension (581) including a plurality of holes (582), each said male extension (581) being adjustably received in the engaging groove (572) of an associated said female extension (571) with the hole (573) of the associated female extension (571) aligned with one of the including a plurality of holes (582), a male pin (583) being located on an upper side of each said female extension (581) and having a stem (584) extended through the aligned holes (573 and 582), and a female pin (585) being located below each said female extension (581) and having a holed stem (586) for fittingly receiving the stem (584) of the male pin (583), thereby engaging the inner ring (51) and the outer ring (52) together to form a rotating wheel (5), the rotating wheel (5) having an overall width that is adjustable by means of aligning the hole (573) of the female extension (571) with different holes (582) of an associated said male extension (581), the rim (58) further including a retaining groove (587) therein and a retainer (588) in the retaining groove (587), the retaining grooves (587 and 574) together receiving the figure card (59), the figure card (59) being wound along the retaining grooves (587 and 574) and having two ends thereof overlapped and retained in place by the retainer (588), the notch (591) of the figure card (59) being engaged with the engaging piece (575) in the rim (57), the rim (58) further including a reference groove (589) in an outer face thereof that faces away from the outer ring (52), the reference groove (589) having a location corresponding to one of the figures on the figure card (59), and a U-shaped shielding plate (8) including a hook device (81) for engaging with the adjusting groove (589) and the groove (587) in the rim (58), the shielding plate (8) being adjustable relative to the reference groove (589).

2. The rotating wheel assembly as claimed in claim 1, wherein one of the beams (21) of the base (2) includes a hole (211), and the other beam (21) includes a lug (212), and wherein the slot machine includes a frame (7), and further comprising an engaging block (71) and a sleeve block (72) screwed to the frame (7), the sleeve block (72) including a receptacle (721) for receiving the lug (212), the engaging block (71) including a cover plate (71 1), the cover plate (711) having an insert (712) formed on an underside thereof for engaging with the hole (211), an operative member (714) extending from the cover plate (711) and including an engaging hook (713) on an underside thereof for engaging with a lateral side of the beam (21) with the hole (211), the operative member (714) is movable away from the beam (21) to allow the base (2) to be removed from the frame (7) by means of disengaging the beams (21) from the engaging block (71) and the sleeve block (72).

* * * * *